US006560928B2

(12) United States Patent
Cabanne et al.

(10) Patent No.: US 6,560,928 B2
(45) Date of Patent: May 13, 2003

(54) SYSTEM FOR ASSEMBLING TWO COMPONENTS OF A WINDOW REGULATOR ACTIVATION DEVICE ON A SUPPORT

(75) Inventors: Damien Cabanne, Fontainebleau (FR); Mark Lawrie, Sully sur Loire (FR); Yann Le Gallo, Orleans (FR); Pascal De Vries, Sandillon (FR); Klaus Blume, Haan (DE); Charles Hopson, Lebanon, TN (US); Hervé Laurandel, Herouville (FR); Simon Dobson, Folkstone (GB)

(73) Assignee: Meritor Light Vehicle Systems -France, Sully-sur-Loire (FR)

( * ) Notice: Subject to any disclaimer, the term of this patent is extended or adjusted under 35 U.S.C. 154(b) by 11 days.

(21) Appl. No.: 09/896,905

(22) Filed: Jun. 29, 2001

(65) Prior Publication Data

US 2002/0007596 A1 Jan. 24, 2002

(30) Foreign Application Priority Data

Jul. 3, 2000 (FR) ..... 00 08586

(51) Int. Cl.[7] ..... E05F 15/08; G05G 5/06
(52) U.S. Cl. ..... 49/349; 74/528
(58) Field of Search ..... 49/349, 348, 352, 49/139, 140; 74/528, 523, 543–546, 547, 89.2, 89.22

(56) References Cited

U.S. PATENT DOCUMENTS 3,635,100 A * 1/1972 Littmann ..... 74/411
3,783,702 A * 1/1974 Dehler ..... 49/349 X
4,085,629 A * 4/1978 Fogarollo ..... 48/139 X
4,229,906 A * 10/1980 Pickles ..... 49/352
4,306,378 A * 12/1981 Fukura et al. ..... 49/352
4,503,732 A 3/1985 Schust
4,748,865 A * 6/1988 Umezawa et al. ..... 74/411
4,753,125 A * 6/1988 Fukumoto et al. ..... 49/352 X
4,770,056 A * 9/1988 Becker et al. ..... 49/352 X
4,878,391 A * 11/1989 Komatsu et al. ..... 49/352 X
5,040,430 A * 8/1991 Adam et al. ..... 49/349 X
5,199,310 A * 4/1993 Yoshimura ..... 49/352 X
5,207,393 A * 5/1993 Marscholl ..... 49/349 X
5,279,468 A * 1/1994 Kuster ..... 49/352 X
5,956,998 A * 9/1999 Fenelon ..... 74/89.17
6,051,901 A * 4/2000 Ishida ..... 49/310 X
6,094,868 A * 8/2000 Otaka et al. ..... 49/349

FOREIGN PATENT DOCUMENTS

DE 44 47 151 A 8/1995
DE 196 19 087 11/1997
DE 197 07 850 C 3/1998

OTHER PUBLICATIONS

INPI Preliminary Search Report dated Feb. 7, 2001.

* cited by examiner

*Primary Examiner*—Daniel P. Stodola
*Assistant Examiner*—Hugh B. Thompson
(74) *Attorney, Agent, or Firm*—Carlson, Gaskey & Olds P.C.

(57) ABSTRACT

A system assembles an apparatus for activating a window on a fixed support. The apparatus includes a drum housing drum cover which has a cover body which is capable of being secured on the fixed support by a first securing member. The cover body includes lugs which block the drum in the drum cover. The system further includes a motor assembly for driving the drum in rotation. The motor assembly includes a principle body which is capable of being secured on the cover body by a second securing member.

21 Claims, 4 Drawing Sheets

SYSTEM FOR ASSEMBLING TWO COMPONENTS OF A WINDOW REGULATOR ACTIVATION DEVICE ON A SUPPORT

This application claims priority to French Application FR 00 08586 filed Jul. 3, 2000.

BACKGROUND OF THE INVENTION

The present invention relates to a system for assembly of an apparatus activating a mobile closure on a fixed support, and more particularly of a system for driving a window regulator, of the cable drum type, on the door panel of a vehicle.

At the present time, the motor and drum cover parts, of a window regulator, are assembled together before being secured on the vehicle. The motor and the drum cover thus form a single element, which may be easily manipulated by an operator. However, in the event of breakdown of the motor, the latter cannot be changed easily. In effect, dismantling of the motor will lead to dismantling of the drum and therefore of the cables which are wound therearound. One of the drawbacks of this solution is that the system cannot be easily repaired in the event of breakdown of the motor for example.

Another embodiment described in Patent Application DE-19619087A1 to Brose solves this problem. However, the system constituted by the motor and the drum cover is not readily adaptable to all types of doors, as an order of assembly on the door must be respected: the cover then the motor (or vice versa).

Another drawback of that Patent is that the drum and the cover are independent before being secured on the door panel, which may raise problems during transport of the window regulator.

DE 44 47 151 discloses a electric window regulator for an automobile vehicle, incorporating cables, whose drum is housed in a cavity made between a cover body and a cap. The cover body is capable of being secured on a fixed support by first securing means and the cap is secured on the cover body. The principal body of the motor which contains the transmission shaft and the reduction gear forms one piece with the cover body. In the event of breakdown of the motor, it is necessary to dismantle the cover body by removing the first securing means, which brings about dismantling of the drum and of the cables wound therearound.

Now, it may sometimes be useful to manipulate the motorized window regulator as an assembly, in order to facilitate transport thereof, while retaining the possibility of dismantling the motor in the event of malfunction. In that case, it should be possible to assemble the window regulator as an assembly constituted by the cover and the motor.

It is an object of the present invention to overcome the drawbacks set forth hereinabove.

SUMMARY OF THE INVENTION

This invention therefore relates to a system for assembly of an apparatus activating a mobile closure on a fixed support, this activation apparatus comprising a drum housed in a drum cover, and a motor assembly for driving the drum in rotation, the drum cover comprising a cover body capable of being secured on the fixed support by first securing means and a cap secured on said cover body, said cover body comprising lugs which, in cooperation with the cap, block the drum in its housing.

According to the invention, this system is characterized in that the motor assembly comprises a principal body capable of being secured on the cover body by second securing means and in such a manner that said motor assembly can be assembled on said cover body before or after the assembly of said cover body on the fixed support.

The cover and motor elements may be assembled on the door panel in two different ways:

Either the cover is secured on the door panel then the motor is secured on the cover.

Or the motor is secured on the cover then the assembly is secured on the door panel.

Assembly of the different elements is therefore more variable, and transport of these elements is facilitated.

In addition, the assembly formed by the drum and its cover is connected so that, even if the cover is not mounted on the door panel, or if the cover of the drum and the motor are not assembled, the drum is still secured in its cover, hence an easier manipulation of the independent elements without risk of the cable escaping from the grooves of the drum.

The following advantageous arrangements are also preferably adopted:

The cap is secured on the cover body by clips.

The motor assembly further comprises a shaft driving a wheel which itself drives the drum with the aid of teeth.

A first O-ring is interposed between the motor assembly and the cover body.

The second securing means are screws.

The motor assembly comprises a manual system driven by a crank.

The manual system comprises a so-called brake jacket system of which the principal body is secured on the cover body by clips or fold-down tabs which are housed in notches.

The system comprises a second O-ring between the manual system and the drum.

A third O-ring is interposed between the cover body and the fixed support.

The third O-ring is moulded or stuck on the cover body and comprises a hook-shaped part which is clipped on the fixed support.

The hook-shaped part is discontinuous over the perimeter of a hole in the fixed support.

The third O-ring is stuck on the fixed support and comprises a hook-shaped part which is clipped on the cover body.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
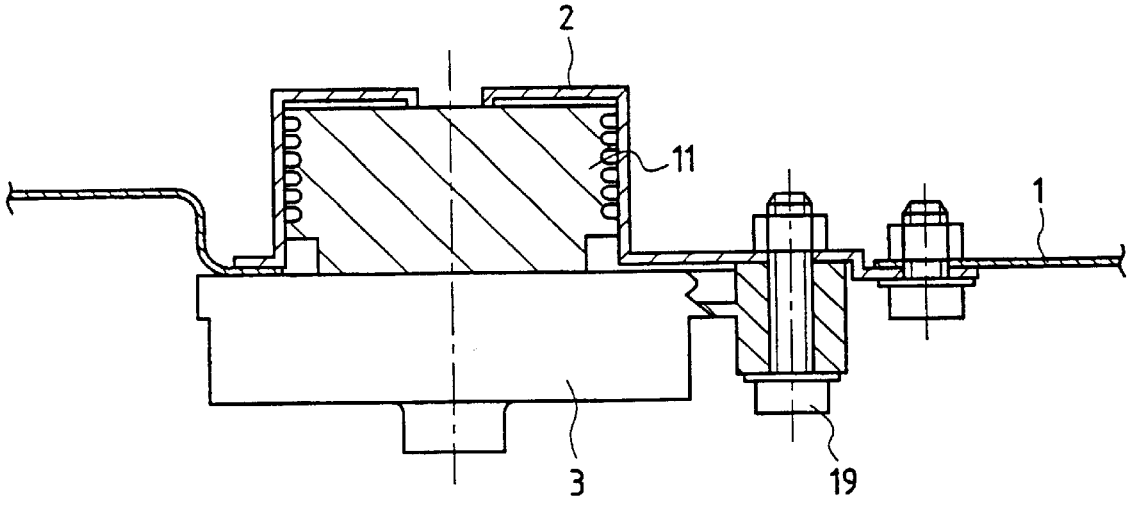
FIG.1 PRIOR ART
FIG. 1 shows a view of the prior art.

Referring now to the drawings, and firstly to FIG. 1, the drum 11 is housed in the cover 2 which is secured on the motor 3 by securing elements 19, for example screws. It will be noted that, if the motor is not assembled, the drum 11 is free to emerge from its housing.

The door panel 1 represents the support of the system, constituted by the drum 11 and its cover 2, and of the motor 3. This door panel 1 may be a stamped metal sheet or a plate of moulded plastics material or any other material which may be pre-formed and used as door panel 1. In the following description, a sheet metal plate will be taken as example.

Figure 2:
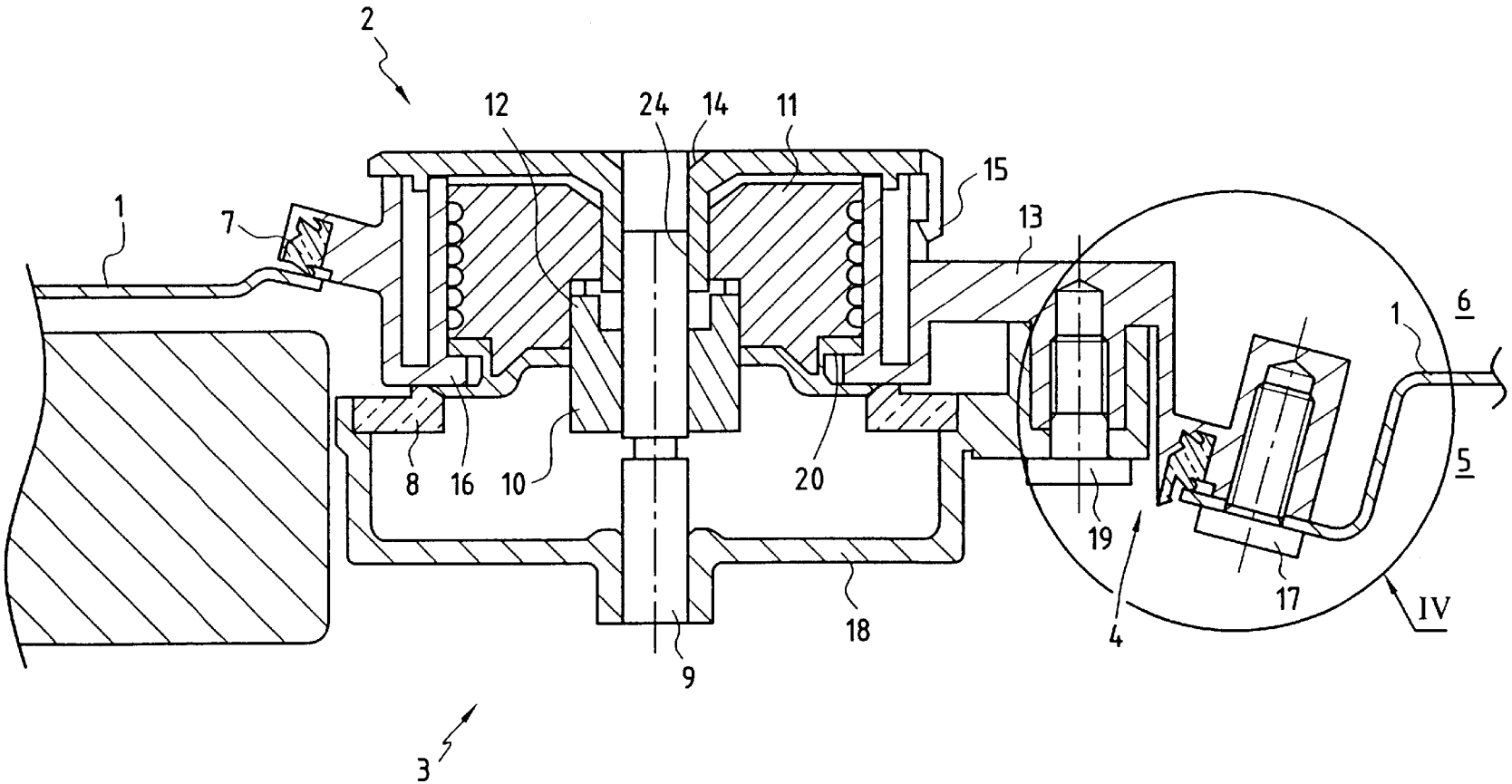
FIG. 2 shows a window regulator system according to the invention in section.

In FIG. 2, the sheet metal plate 1 is constituted by a stamped metal sheet pierced with a hole 4 allowing the different elements to pass through, its shape being defined so that it delimits the dry side 5 and the wet side 6, the motor being located on the dry side and the cable and drum on the wet side.

Tightness is ensured with the aid of seals: a first O-ring 7 for the seal between the plate and the cover, and a second O-ring 8 for the seal between the cover and the motor.

The motor 3 is constituted by a shaft 9 which drives the wheel 10, which itself drives the drum 11 thanks to teeth 12. The other elements of the motor are known and will not be described.

The cover 2 of the drum 11 is constituted by a first part 13 constituting the body of the cover, and by a second part 14 constituting a cap which is secured on the body 13, thanks to clips 15 for example, at the same time as the drum 11 is positioned in the cover cables (not shown) are also positioned around the drum.

The cap 14 and the lugs 16 block the drum, which allows the cover/drum assembly to be easily transported.

The assembly thus constituted may then be mounted on the sheet metal 1 and secured for example by screws 17 regularly distributed on the periphery.

The motor 3 assembly further comprises a principal body 18 which is secured on the cover for example by regularly distributed screws 19.

It may also be imagined that the assemblies 2 and 3 are firstly joined and secured together by screws 19, before securing the assembly thus obtained on the sheet metal 1 with the aid of screws 17.

The system can then be mounted in different ways, which facilitates assembly and allows several possibilities as to the order of assembly of the different elements.

It will be noted that the screw heads are all on the dry side of the sheet metal, i.e. they are easily accessible to the person assembling and dismantling the system.

The securing means 17 and 19 may easily be constituted by clips which must be dismountable. Such securing means offer less rigidity, but are more profitable as to the assembly time.

Another possibility concerning the cover of the drum would be to make the opening to introduce the drum on the motor side. The cap 14 would in that case be on the motor side, the lugs 16 would be made by a particular shape of the cap 14. This system would make it possible, after dismantling of the motor, to have access to the drum after the cap 14 has been unclipped, and this without dismantling the screws 17. There would thus be access to all the parts from the same side, which facilitates repairs in the event of breakdown of one of the mobile elements.

Another advantage is that the take-up bearing 24, which was on the part 14 and was more or less rigid, is now on the part 13 which is more rigid, this improving the mechanical strength of the bearing and the precision of alignment of the shafts.

Figure 3:
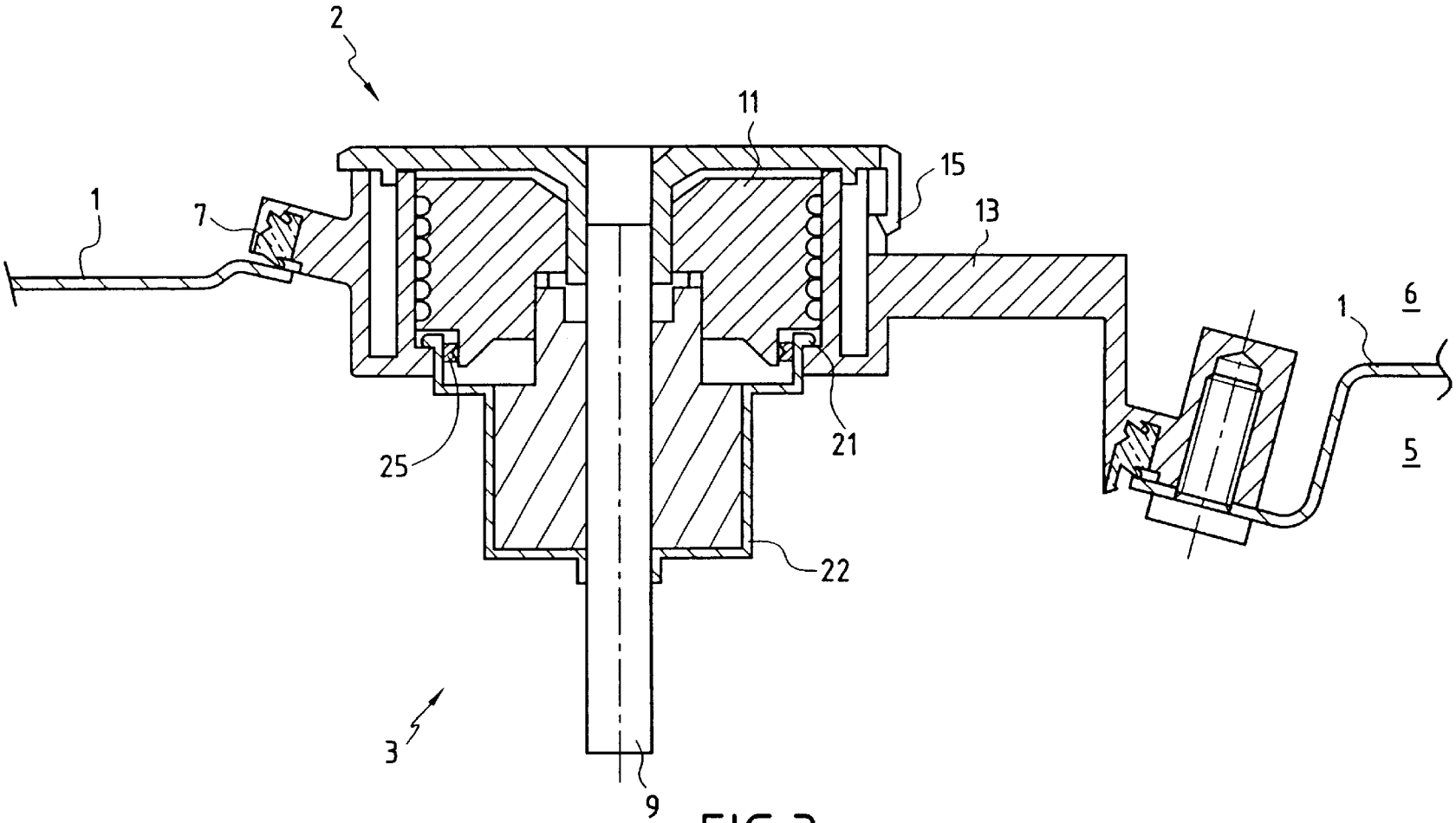
FIG. 3 shows another embodiment of the invention.

FIG. 3 shows the invention in the case of a manual window regulator.

The system envisaged is a motorized window regulator but this principle may very well be adapted to a manual one. In that case, the shaft 9 becomes the rotation shaft driven by the user's crank. The motor is in that case replaced by a manual system 22 which may comprise a so-called brake jacket system which is secured beneath the body 13 thanks to clips or fold-down tabs 21 housed in the notches 20.

The notches 20 of this configuration will advantageously be placed inside the so-called wet zone of the motorized configuration defined by the inner perimeter of the O-ring 8. The tightness which is ensured by O-rings 8 in the motorized case is ensured by the tabs 21 which are housed in the notches 10, this obstructing them and preventing water from penetrating inside the dry zone in the manual case. It may also be envisaged having an O-ring 25 positioned between the manual system 22 and the drum.

One sole component 13 may therefore be envisaged for the manual or electric systems, this allowing savings to be made by rationalizing production of the different types of window regulators.

Figure 4:
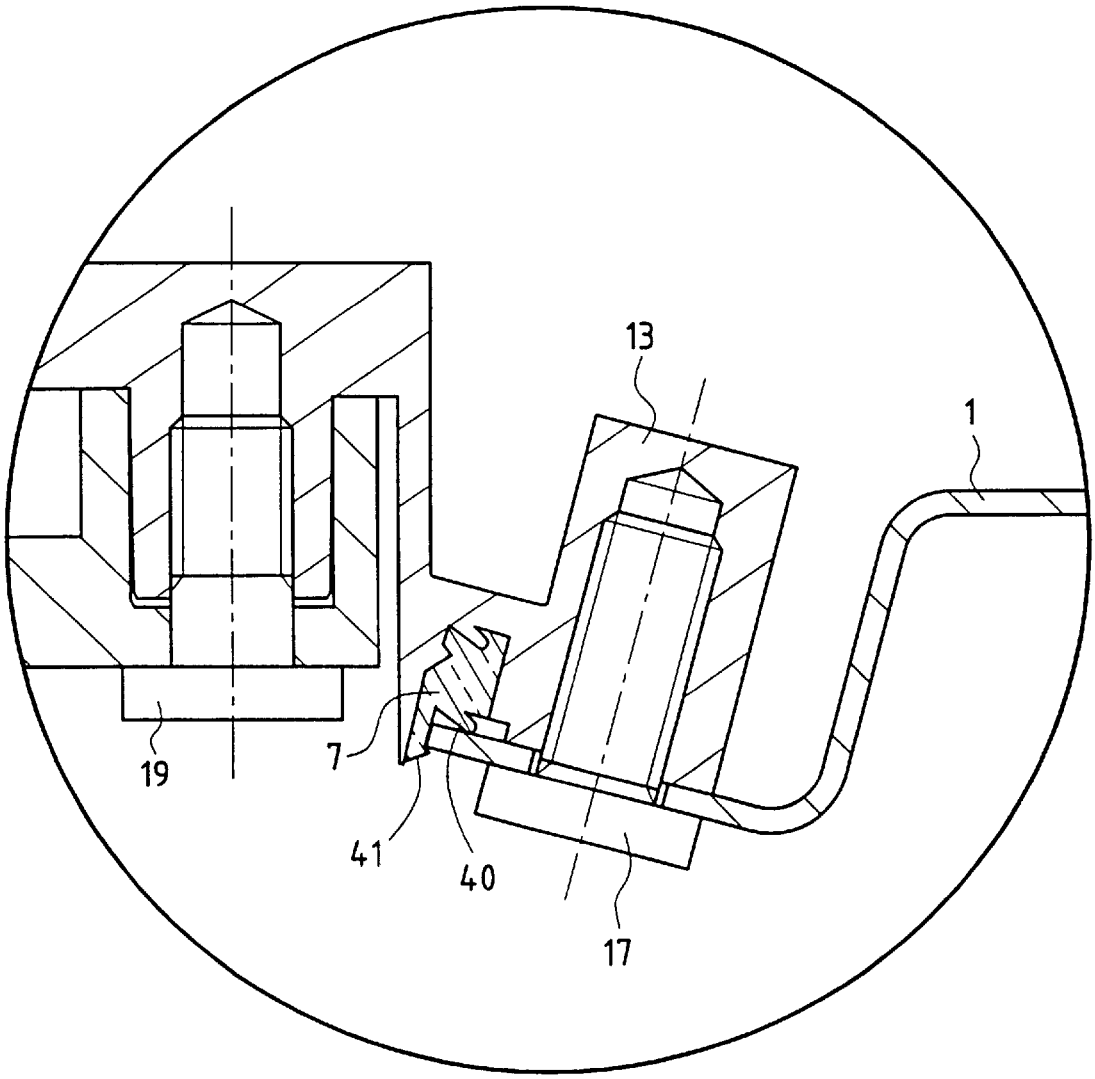
FIG. 4 shows an enlarged view of part of the invention (detail IV of FIG. 2).

FIG. 4 shows another embodiment of the invention.

When the cover 2 is secured on the plate 1 by the securing means 17, it is necessary for the operator to hold the cover 2, but, in the case of assembly in a door, where the dimensions are reduced, it is sometimes difficult to hold the cover and secure the securing means 17 at the same time. A means is therefore necessary which ensures sufficient hold of the cover 2 on the plate 1 to allow the operator to secure the cover 2 on the plate 1 by the securing means 17 without having to hold the cover during this operation.

This role of hold may be performed by the seal 7 which, by the addition of a special shape, may be anchored in the plate 1. The shape of the seal 7 includes, in addition to part 40 which provides tightness, a part 41 in the form of a hook, which, by clipping on the plate 1, makes it possible to hold the cover 2.

The hook-shaped part 41 may be continuous all along the seal or a plurality of hook-shaped parts may be distributed along the seal, in which case the hook-shaped part 41 is discontinuous over the perimeter of the hole 4 in the fixed support 1.

These shapes ensure not only the hold of the cover 2 on the plate 1, but they also improve tightness and make it possible to position the cover 2 with respect to its housing in the plate 1.

The seal may be moulded or stuck on the cover in conventional manner. The seal may also be stuck on the plate 1 and, in that case, the shapes 41 clip on the cover.

A preferred embodiment of this invention has been disclosed. However, a worker of ordinary skill in this art would recognize that certain modifications would come within the scope of this invention. For that reason, the following claims should be studied to determine the true scope and content of this invention.

What is claimed is:

1. A system for assembling an apparatus for activating a mobile closure on a fixed support comprising:

the fixed support;

the apparatus including a drum housed in a drum cover, the drum cover including a cover body capable of being secured on the fixed support by a first securing member and a cup secured on said cover body, said cover body further including lugs which, in cooperation with the cap, block the drum in said drum cover the cap blocking a first side of the drum and the lugs blocking an opposing second side of the drum; and a motor assembly for driving the drum in rotation including a principal body capable of being secured on the cover body by a second securing member and so that said motor assembly can be assembled on said cover body before or after the cover body has been assembled on the fixed support.

2. The system of claim 1, wherein the cap is secured on the cover body by clips.

3. The system of claim 1, wherein the fixed support is a vehicle door panel.

4. The system of claim 1, wherein the motor assembly further includes a shaft driving a wheel having teeth, and the wheel drives the drum by the teeth.

5. The system of claim 4, wherein a first O-ring is interposed between the motor assembly and the cover body.

6. The system of claim 1, wherein the motor assembly includes a manual system driven by a crank.

7. The system of claim 1, wherein a third O-ring is interposed between the cover body and the fixed support.

8. The system as recited in claim 1 wherein the second securing member is a screw.

9. A system for assembling an apparatus for activating a mobile closure on a fixed support comprising:

the fixed support;

the apparatus including a drum housed in a drum cover, the drum cover including a cover body capable of being secured on the fixed support by a first securing member and a cap secured on said cover body, said cover body further including lugs which, in cooperation with the cap, block the drum in said drum cover; and a motor assembly for driving the drum in rotation including a principal body capable of being secured on the cover body by a second securing member and so that said motor assembly can be assembled on said cover body before or after the cover body has been assembled on the fixed support; and a manual system driven by a crank, and wherein the manual system includes a brake jacket system of which the principal body is secured on the cover body by clips or fold-down tabs housed in notches of the cover body.

10. The system of claim 9, further including a second O-ring between the manual system and the drum.

11. A system for assembling an apparatus for activating a mobile closure on a fixed support comprising:

the fixed support;

the apparatus including a drum housed in a drum cover, the drum cover including a cover body capable of being secured on the fixed support by a first securing member and a cap secured on said cover body, said cover body further including lugs which, in cooperation with the cap, block the drum in said drum cover; and a motor assembly for driving the drum in rotation including a principal body capable of being secured on the cover body by a second securing member and so that said motor assembly can be assembled on said cover body before or after the cover body has been assembled on the fixed support, and wherein a third O-ring is interposed between the cover body and the fixed support, and wherein the third O-ring is molded or stuck on the cover body and includes a part in the form of a hook, which clips on the fixed support.

12. The system of claim 11, wherein the hook-shaped part is discontinuous over the perimeter of a hole in the fixed support.

13. A system for assembling an apparatus for activating a mobile closure on a fixed support comprising:

the fixed support;

the apparatus including a drum housed in a drum cover, the drum cover including a cover body capable of being secured on the fixed support by a first securing member and a cap secured on said cover body, said cover body further including lugs which, in cooperation with the cap, block the drum in said drum cover; and a motor assembly for driving the drum in rotation including a principal body capable or being secured on the cover body by a second securing member and so that said motor assembly can be assembled on said cover body before or after the cover body has been assembled on the fixed support, and wherein a third O-ring is interposed between the cover body and the fixed support, and wherein the third O-ring is stuck on the fixed support and comprises a hook-shaped part, which clips on the cover body.

14. A system for assembling an apparatus for activating a mobile closure on a vehicle door comprising:

said vehicle door;

the activation apparatus including a drum housed in a drum cover, the drum cover including a cover body capable of being secured on the fixed support by a first securing member and a cap secured on said cover body, said cover body further including lugs which, in cooperation with the cap, block the drum in said drum cover; and a motor assembly for driving the drum in rotation including a principal body capable of being secured on the cover body by a second securing member and so that said motor assembly can be assembled on said cover body before or after said cover body has been assembled on vehicle door and a manual system driven by a crank including a brake jacket system of which the principal body is secured on the cover body by clips or fold-down tabs housed in notches of the cover body, and a shaft driving a wheel having teeth, and the wheel drives the drum by the teeth.

15. The system of claim 14, wherein the cap is scoured on the cover body by clips.

16. The system of claim 14, wherein a first O-ring is interposed between the motor assembly and the cover body.

17. The system of claim 14, wherein the second securing member are screws.

18. The system of claim 14, further including a second O-ring between the manual system and the drum.

19. The system of claim 14, wherein a third O-ring is interposed between the cover body and the vehicle door.

20. The system of claim 19, wherein the third O-ring is moulded or stuck on the cover body and comprises a part in the form of a hook, which clips on the fixed support.

21. A system for assembling an apparatus for activating a mobile closure on a fixed support comprising:

the fixed support;

to apparatus including a drum housed in a drum cover, the drum cover including a cover body capable of being secured on the fixed support by a first securing member and a cap secured on said cover body, said cover body further including lugs which, in cooperation with the cap, block the drum in said drum cover; and a motor assembly for driving the drum in rotation including a principal body capable of being secured on the cover body by a second securing member, and wherein the second securing member are screws, and so that said motor assembly can be assembled on said cover body before or after the cover body has been assembled on the fixed support, and farther including a shaft that drives a wheel having teeth, and a first o-ring is interposed between the motor assembly and the cover body.

* * * * *

UNITED STATES PATENT AND TRADEMARK OFFICE

CERTIFICATE OF CORRECTION

PATENT NO. : 6,560,928 B2
DATED : May 13, 2003
INVENTOR(S) : Cabanne et al.

It is certified that error appears in the above-identified patent and that said Letters Patent is hereby corrected as shown below:

Column 4,
Line 66, "cup" should be -- cap --.

Column 6,
Line 49, "14" should be -- 16 --.
Line 62, "to" should be -- the --.

Signed and Sealed this

Sixteenth Day of September, 2003

JAMES E. ROGAN
*Director of the United States Patent and Trademark Office*